United States Patent [19]

Pringle

[11] Patent Number: 4,691,776

[45] Date of Patent: Sep. 8, 1987

[54] RETRIEVABLE WELL SAFETY VALVE WITH EXPANDABLE EXTERNAL SEALS

[75] Inventor: Ronald E. Pringle, Houston, Tex.

[73] Assignee: Camco, Incorporated, Houston, Tex.

[21] Appl. No.: 868,916

[22] Filed: May 29, 1986

[51] Int. Cl.[4] ..... E21B 34/10

[52] U.S. Cl. ..... 166/319; 166/322; 166/332

[58] Field of Search ..... 166/319, 321, 322, 332, 166/375

[56] References Cited

U.S. PATENT DOCUMENTS

| | | | |
|---|---|---|---|
| 3,799,204 | 3/1974 | Watkins et al. | 137/629 |
| 3,874,634 | 4/1975 | Gazda et al. | 166/322 X |
| 4,538,685 | 9/1985 | Pringle et al. | 166/321 |
| 4,585,067 | 4/1986 | Blizzard et al. | 166/319 X |
| 4,601,341 | 7/1986 | Pringle et al. | 166/321 |

*Primary Examiner*—Stephen J. Novosad

*Attorney, Agent, or Firm*—Fulbright & Jaworski

[57] ABSTRACT

A retrievable subsurface well safety valve for installation in and controlling fluid through a well conduit having a polished bore. Two upper seals are provided on the exterior of the valve for isolating the control fluid for actuating a piston and cylinder assembly. A lower seal is provided adjacent the valve closure member for blocking fluid flow through the valve housing. The seals initially have a smaller outside diameter than the internal diameter of the polished bore and the outside diameter of the valve housing for preventing damage to the seals while running in the well conduit. The seals are expanded into engagement with the polished bore either mechanically or hydraulically.

7 Claims, 4 Drawing Figures

RETRIEVABLE WELL SAFETY VALVE WITH EXPANDABLE EXTERNAL SEALS

BACKGROUND OF THE INVENTION

It is well known, as illustrated in U.S. Pat. No. 3,799,204 to use a retrievable safety valve for insertion into a well conduit for controlling fluid flow through the conduit. In such installations, the well conduit includes a polished bore for receiving interference fit external seals on the safety valve for straddling the fluid control line from the well surface which provides control fluid to the safety valve for actuating a piston and cylinder assembly for opening and closing the safety valve. However, because the interference fit seals protrude from the exterior surface of the valve housing to provide a tight sealing relationship with the polished bore, the seals may be damaged as the safety valve is lowered through the well conduit. In addition, the safety valve housing generally includes a plurality of threaded sections which are joined together and sealed by elastomer type O-rings. These O-rings are subject to failure due to temperature limitations, corrosive well fluids and a limited life.

One feature of the present invention is the provision of seals on the exterior of the valve housing which are initially in a retracted protected position for limiting damage to the seals while the safety valve is run into the well conduit. The seals are then expanded either mechanically or hydraulically into an expanded and sealing engagement with the polished bore. Another feature of the present invention is the provision of a normally retracted but expandable seal adjacent to and above the safety valve closure member for sealing off well fluids between the interior and exterior of the valve housing and keeping the body from collapse. Another feature is the provision of a retrievable safety valve capable of withstanding both high and low temperature environments.

SUMMARY

The present invention is directed to a retrievable subsurface well safety valve for controlling fluid flow through a well conduit having a polished bore. The valve includes a tubular housing having a fluid control port, a bore and a valve closure member moving between open and closed positions for controlling the fluid flow through the bore. A flow tube is telescopically movable in the housing for controlling the movement of the valve closure member and biasing means are provided for moving the flow tube in a direction to close the valve. Piston and cylinder assembly means in the housing engages the flow tube and the assembly is exposed to the fluid port for receiving control fluid for actuating the assembly and the flow tube. External seal means are supported by the housing for sealing in the polished bore of the well conduit. The seal means includes a first seal having a first and second end in which the first end abuts the housing for preventing movement of the first end and a longitudinally movable piston abuts the second end of the first seal. The first seal initially has an outer periphery of a size less than the size of the inner periphery of the polished bore and less than the maximum outside diameter of the valve housing. The seal means includes a second seal connected to the piston for moving the piston against the first seal for expanding the first seal into engagement with the polished bore and the second seal is sized to form an interference fit with the polished bore for actuating the piston upon the application of fluid pressure on the second seal. Means are provided for holding the first seal means in an expanded position.

Still a further object of the present invention is wherein the seal means is positioned above and adjacent to the valve closure member.

Yet a still further object of the present invention is wherein the housing includes a top section and a bottom section and the sections are telescopically movable relative to each other in which the bottom section includes the valve closure member and the seal means is positioned between the top section and the bottom section and releasable locking means initially prevents movement of the sections relative to each other.

Yet a still further object of the present invention is the provision of an additional external seal means on the exterior of the housing on each side of the fluid control port. Each additional seal means includes a third seal having a first and second end with the first end of the third seal abutting the housing and a longitudinally movable piston abuts the second end of the third seal. The third seal initially has an outer periphery of a size less than the size of the inner periphery of the polished bore and less than the maximum outside diameter of the valve housing. A fourth seal is connected to the piston and is exposed to the port for moving the piston against the third seal for expanding the third seal into engagement with the polished bore. The fourth seal is sized to form an interference fit with the polished bore for actuating the piston upon application of fluid pressure to the port. Means are provided for holding the third seal in an expanded position.

Still a further object of the present invention is wherein the first and third seals include metal seal means.

Still the present invention is directed to the provision of a mechanically set seal on the exterior of the housing in which the mechanically set seal includes first and second spaced seals connected together in which the seals are positioned on opposite sides of the fluid control port. The first and second mechanically set seals initially have an outer periphery of a size less than the size of the inner periphery of the polished bore and less than the maximum outside diameter of the housing. One end of the mechanically set seals are positioned against the housing and the mechanical set seal has a no-go shoulder for engaging the well conduit for expanding the mechanically set seals into engagement with the polished bore. Means are provided for holding the mechanically set seal in an expanded position.

A further object of the present invention is the provision of a retrievable well packer having a structure to withstand both high and low temperature environments.

Other and further objects, feature and advantages will be apparent from the following description of presently preferred embodiments of the invention, given for the purpose of disclosure and taken in conjunction with the accompanying drawings.

DESCRIPTION OF THE PREFERRED EMBODIMENT

While the present invention of expandable seals on the exterior of a retrievable well safety valve will be described in connection with a well safety valve that is particularly designed to withstand both high and low temperatures, for purposes of illustration only, the present invention is also useful in other types of retrievable well safety valves.

Figure 1A:
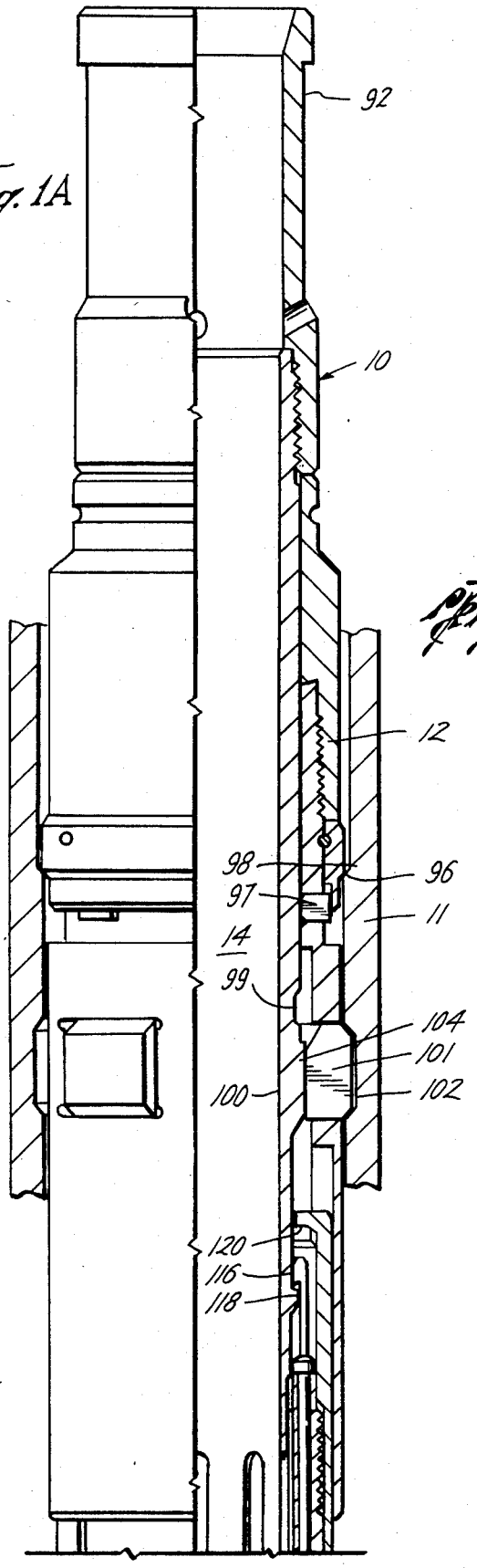
FIGS. 1A, 1B and 1C continuations of each other and are elevational views in quarter section of the preferred embodiment of the present invention.
Figure 1B:
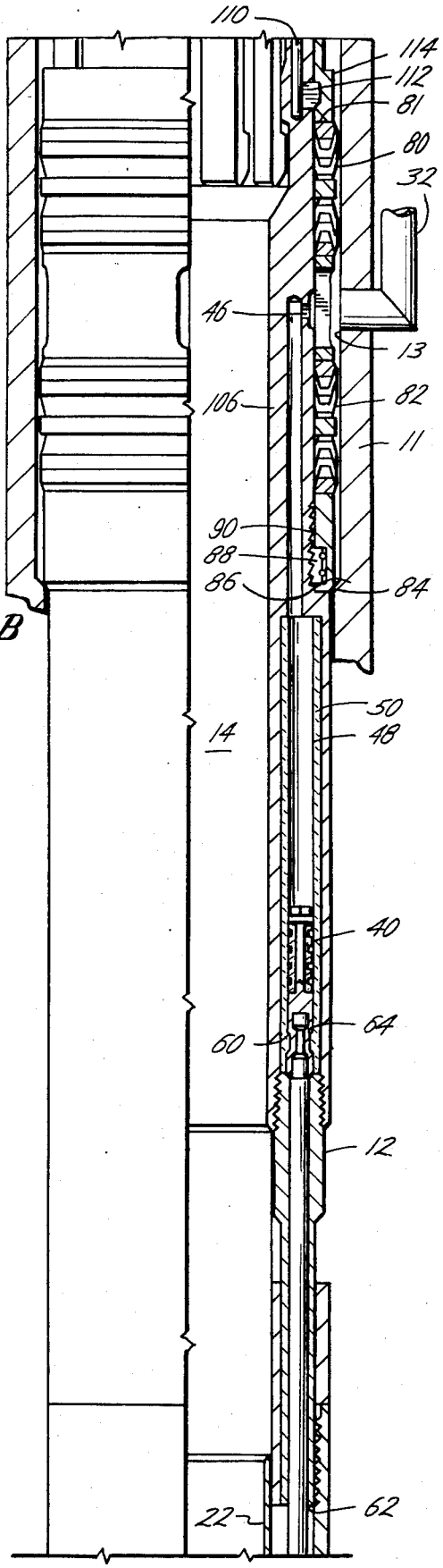

Referring now to the drawings and particularly to FIGS. 1A, 1B and IC, the reference numeral 10 generally indicates a retrievable subsurface safety valve of the present invention which includes a housing 12 which is adapted to be connected in a well conduit or well tubing 11 to permit well production therethrough under normal operating conditions, but in which the safety valve 10 may close or be closed in response to abnormal conditions.

The valve 10 includes a bore 14, a valve closure member such as flapper valve 18 (FIG. 1C) connected to the body 12 by a pivot pin 20. When the flapper valve 18 is in the upper position and seated on a valve seat 16, the safety valve 10 is closed blocking flow upwardly through the bore 14 and the well tubing 11.

Figure 1C:
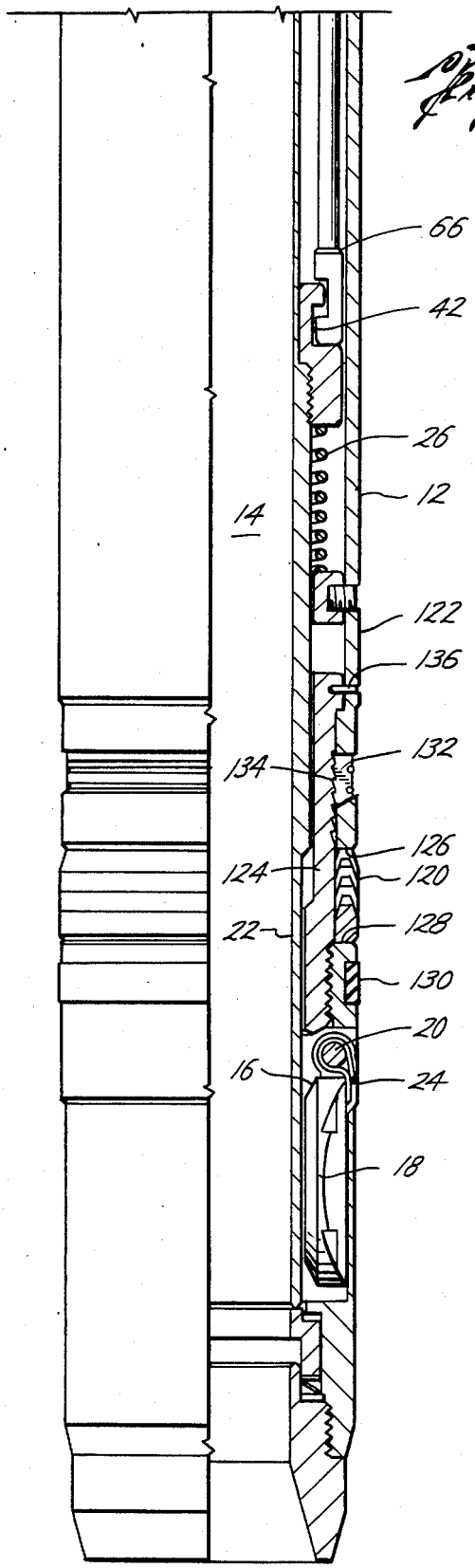

A flow tube 22 is telescopically movable in the body 12 and through the valve seat 16. As best seen in FIG. 1C, when the flow tube 22 is moved to a downward position the tube 22 pushes the flapper 18 away from the valve seat 16. Thus, the valve is held in the open position so long as the tube 22 is in the downward position. When the tube 22 is moved upwardly, the flapper 18 is allowed to move upwardly onto the seat 16 by the action of a spring 24.

The flow tube 22 is biased upwardly by any suitable means which may include a spring 26 for yieldably urging the flow tube 22 in an upward direction to release the flapper 18 for closing the valve 10. The safety valve 10 is controlled by the application or removal of a pressurized fluid, such as hydraulic fluid, steam, or nitrogen through a control path or line, such as control line 32 extending to the well surface or through the casing annulus, which supplies pressurized fluid to the top of one or more pistons 40 which are connected to the flow tube 22 by a tongue and groove connection 42 for moving the flow tube 22 downwardly forcing the flapper 18 off of the seat 16 and into the full open position. The safety valve 10 is controlled by the application or removal or pressurized fluid through the control line 32 and a fluid control port 46 in the housing 12 is provided to supply control fluid to a cylinder 48 and the top of the piston 40. The bottom of the piston 40 is exposed to fluid pressure in the bore 14, or in other types of safety valves, to annulus fluid which acts against the bottom of the piston 40 for biasing the flow tube 22 to the closed position when the fluid control pressure is removed from the control line 32.

The safety valve 10 provides a solution to both high and low temperature seal problems in a safety valve and as more fully described in U.S. patent application Ser. No. 06/710,737, filed Mar. 11, 1985, the piston 40 is preferably of a suitable ceramic which operates in the cylinder 48 having a ceramic seal 50. The ceramic piston 40 and the ceramic sleeve 50 have sufficient lubricity that they can withstand the extremely high temperatures encountered in steam injection wells and avoid the use of elastomer seals. Positive valve seals are provided between the piston and cylinder to provide a positive seal in both directions. Thus, a coacting metal valve seat 60 and metal valve element 64 seat when flapper 18 opens for blocking the bypass of any control fluid through the piston and cylinder assembly while the valve is open. Similarly, metal valve seat 62 and metal valve element 66 are provided to provide a positive seal when the valve 10 moves to the open position to block the passage of well fluid past the piston 40.

The above description is generally disclosed in application Ser. No. 06/710,737 and is incorporated herein by reference. However, in a retrievable safety valve, the valve is lowered into place in the well tubing 11, such as on a wire line or pump down, into a polished bore 13 on the inside of the tubing 11 for providing a good sealing surface in which the fluid control port 46 in the housing 12 is placed in communication with the control line 32. To direct the flow from the flow line 32 to the port 46, it is generally conventional to provide two upper seals which are positioned on opposite sides of the port 46 and which provide an interference fit with the polished bore 13 in order to properly seal off the incoming control fluid. Therefore, in order to insure a good sealing engagement with the polished bore 13, the seals will protrude from the exterior of the housing 12. However, this subjects the seals to possible damage while running in the bore of the well tubing 11 thereby causing the seals to fail in their function of sealing.

One feature of the present invention is the provision of external seal means on the valve 10 which are initially in a retracted position having an outer periphery of a size less than the size of the inner periphery of the polished bore 13 and also less than the maximum outside diameter of the valve housing 12 whereby the valve 10 may be lowered into the well tubing 11 and reduce the possible damage to the seals while installing the valve 10. For example only, the seals may have a diameter of 0.020 inches less than the ID of the polished bore 13. Referring now to FIG. 1B, the embodiment of the present invention is the provision of a mechanically set seal means on the exterior of the housing 12 which includes a first 80 and a second 82 spaced seals which are preferably connected together and positioned on opposite sides of the fluid control port 46. One end of the seals such as end 81 abuts against the housing release shoulder 114 and the mechanical set seal includes a no-go shoulder 84 for engaging a setting shoulder 86 in the well tubing. After the shoulders 84 and 86 are engaged, further downward movement of the housing 12 compresses and expands the seals 80 and 82 outwardly into a tight sealing relationship with the polished bore 13. Means for holding the mechanically set seal in an expanded position are provided such as a ratchet 88 connected to the seals 80 and 82 and coacting ratchet teeth 90 on the housing 12. While of course the seals 80 and 82 may be of any suitable material, it is preferable that the seals for overcoming high and low temperatures include metal sealing elements such as metal V-rings alternating with high temperature plastic V-rings such as the type sold under the trademark "Teflon". Other types of metal sealing rings may be used, such as metal wire mesh.

Referring now to FIGS. 1A and 1B, the safety valve 10 is installed in the well tubing 11. The safety valve 10 includes a standard running and pulling head 92 which is initially extended and held extended by a running tool. The body 12 includes a stop shoulder 96 which engages a shoulder 98 on the well tubing 11 for initially positioning the valve and initiating the setting operations. Shoulder 96 initially locks latch 97 into groove 99 of setting and release collet 100. Engagement of the shoulder 98 by shoulder 96 shears a pin (not shown) allowing the body 12 to move down relative to shoulder 96 releasing the latch 97 and collet 100. With the locking dogs 101 adjacent locking groove 102 in the tubing 11, downward movement of the collet 100 moves the wedges 104 beneath the locking dogs 101 to lock the safety valve 10 in the tubing 11. Also downward movement of the body 12 moves body 12 downwardly whereby the no-go shoulder 84 contacts the no-go seat 86 and expands the seals 80 and 82 where they are held in the expanded position by the ratchet 88.

The retrievable safety valve 10 may be released by engaging the member 92 with a standard pulling tool which causes the member 92 to move upwardly removing the wedge surface 104 behind the locking dogs 101 and a seal release pin 110, which normally holds a lock 112 in engagement with the seal release shoulder 114, is pulled upwardly through connections 116 and 118 and further upward movement of the collet 100 engages release shoulder 120 on the seal release shoulder 114.

Another feature of the present invention is, as best seen in FIG. 1C, a third external seal means which is used to block off the fluid flow of the fluid in the well bore below the valve 10 from the exterior of the valve 10 and prevent collapse of the body 12. Conventionally, the housing 12 is made up of a plurality of threaded tubular members which are joined together by elastomer O-ring seals for protecting the housing. The present seal means is positioned and set externally of the housing 12 for blocking off flow between the outside of the housing and the well tubing 11. The seal means includes seal 120 which is adapted to have an outer periphery of a size less than the size of the inner periphery of the polished bore 13 of the well tubing 11 and less than the maximum outside diameter of the housing 12 and by way of example may be of a smaller diameter of 0.020 inches less than the ID of the polished bore 13 in its initial retracted position. The seal 120 may be of a composition similar to the seals 80 and 82 and includes a metal seal such as a plurality of annular metal V-rings alternating with a synthetic seal such as sold under the trademark "Teflon." The housing 12 includes a top section 122 and a bottom section 124 which is telescopically movable relative to the top section 122. The seal 120 is positioned between a shoulder 126 on the top section 122 and a shoulder 128 on the bottom section 124. The external seal means includes a second seal 130 which is connected to the section 124 forming a piston. The seal 130 provides a piston by having an interference fit with the polished bore 13 of the tubing 11 and may be a sacrificial elastomer seal whose function is to compress the seal 120 into an expanded and set position with the polished bore 13 of the tubing 11. Means are provided for holding the first seal 120 in the expanded position such as a ratchet 132 on the member 122 and ratchet threads 134 on the bottom section 124. After the valve 10 is set in the tubing 11, the safety valve 10 is closed with the flapper 18 seating on the valve seat 16. With the safety valve closed, tubing pressure in the bore 14 above the flapper valve 18 is reduced and the differential pressure across the seal 130 will move seal 130 upwardly compressing the seal 120 into an expanded position. Releasable locking means such as a shear pin 136 is provided for initially holding the top section 122 and the bottom section 124 together to prevent setting of the seal 120 prior to reaching the proper location.

It is to be noted that the seal 120 is positioned adjacent flapper 18 and prevents well bore fluid from any threaded connections in the body 12. Therefore, conventional O-rings may be omitted from the interconnection between housing sections.

In retrieving the safety valve 10, an upward pull on the safety valve and top housing section 122 will shear the connection between the ratchet 132 and threads 134 for releasing the seal 120.

Figure 2:
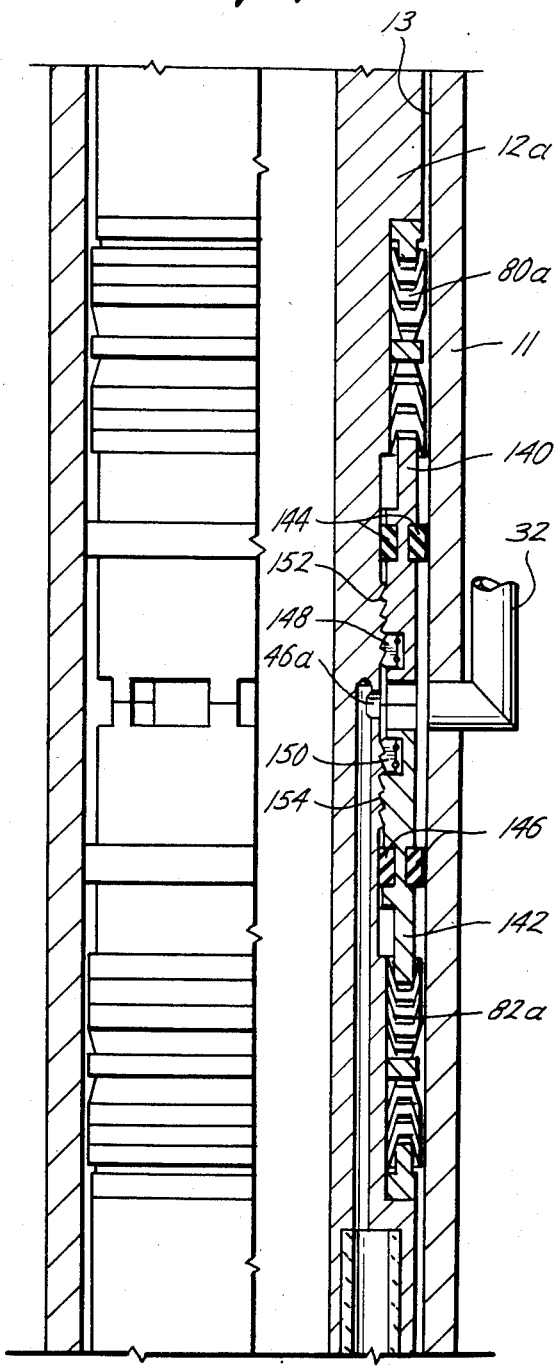
FIG. 2 is a fragmentary elevational view, in cross section, of another form of the present invention of the upper seals for isolating the control fluid.

While the setting of the seals 80 and 82 in FIG. 1B has been illustrated as being mechanically set, another embodiment of the upper seals is shown in FIG. 2 in which the seals are set by hydraulic pressure. Like parts to those shown in FIG. 1B are similarly numbered in FIG. 2 with the addition of the suffix "a". Thus, seals **80*a* and 82*a* are provided on the outside of the housing 12*a* and positioned on opposite sides of the fluid control port 46*a*. Each of the seals 80*a* and 82*a* include a first end abutting the housing 12*a* for preventing movement of the first end with a longitudinally movable piston 140 and 142 abutting the second end of the seals 80*a* and 82*a*, respectively. The seals 80*a* and 82*a* are similar to the seals 80 and 82 and have a smaller diameter than the internal diameter of the polished bore 13 of the well tubing 11 and the outside diameter of the housing 12. Each of the pistons 140 and 142 include an interference fit seal such as seals 144 connected to piston 140 and seals 146 connected to piston 142. The seals 144 and 146 provide an interference fit with the polished bore 13 and may be sacrificial elastomer seals merely for expanding the seals 80*a* and 82*a*, respectively. Each of the pistons 140 and 142 are connected to means for holding the seals 80*a* and 82*a*, respectively, in the expanded position and may be ratchets 148 and 150, respectively, which coact with ratchet threads 152 and 154, respectively, on the housing 12*a*. The seals 80*a* and 82*a* are moved from a retracted to a set and expanded position in engagement with the polished bore 13 by applying fluid pressure through the control line 32 acting against the pistons 140 and 142**, respectively.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will readily suggest themselves to those skilled in the art and which are encompassed within the spirit of the invention and the scope of the appended claims.

What is claimed is:

1. A retrievable subsurface well safety valve for controlling fluid flow through a well conduit having a polished bore comprising, a tubular housing having a fluid control port and having a bore and having a valve closure member moving between open and closed positions for controlling the fluid flow through the bore, a flow tube telescopically moving in the housing for controlling the movement of the valve closure member, biasing means for moving the flow tube in a direction to close the valve, piston and cylinder assembly means in the housing, said assembly engaging the flow tube and said assembly exposed to the fluid port for receiving control fluid for actuating the assembly and flow tube, external means supported by the housing for sealing in the polished bore of the well conduit, said seal means including a first seal having a first and second end, the first end abutting the housing for preventing movement of the first end, a longitudinally movable piston abutting the second end of the first seal, said first seal initially having an outer periphery of a size less than the size of the inner periphery of the polished bore and less than the maximum outside diameter of the housing, said seal means including a second seal connected to the piston for moving the piston against the first seal for expanding the first seal into engagement with the polished bore, said second seal sized to form an interference fit with the polished bore for actuating the piston upon the application of fluid pressure on the second seal, means for holding the first seal means in an expanded position, an additional external seal means on the exterior of the housing on each side of the fluid control port, each additional seal means including a third seal having a first and second end, the first end of the third seal abutting the housing for preventing movement of the first end, a longitudinally movable piston abutting the second end of the third seal, said third seal initially having an outer periphery of a size less than the size of the inner periphery of the polished bore and less than the outside diameter of the housing, and including a fourth seal connected to the piston and exposed to the port for moving the piston against the third seal for expanding the third seal into engagement with the polished bore, said fourth deal sized to form an interference fit with the polished bore for actuating the piston upon application of fluid pressure to the port, and means for holding the third seal in an expanded position.

2. The apparatus of claim 1 wherein the first seal includes a metal seal.

3. The apparatus of claim 1 wherein the third seal includes a metal seal.

4. A retrievable subsurface well safety valve for controlling fluid flow through a well conduit having a polished bore comprising, a tubular housing having a fluid control port and having a bore and having a valve closure member moving between open and closed positions for controlling the fluid flow through the bore, a flow tube telescopically moving in the housing for controlling the movement of the valve closure member, biasing means for moving the flow tube in a direction to close the valve, piston and cylinder assembly means in the housing, said assembly engaging the flow tube and said assembly exposed to the fluid port for receiving control fluid for actuating the assembly and flow tube, external means supported by the housing for sealing in the polished bore of the well conduit, said seal means including a first seal having a first and second end, the first end abutting the housing for preventing movement of the first end, a longitudinally movable piston abutting the second end of the first seal, said first seal initially having an outer periphery of a size less than the size of the inner periphery of the polished bore and less than the maximum outside diameter of the housing, said seal means including a second seal connected to the piston for moving the piston against the first seal for expanding the first seal into engagement with the polished bore, said second seal sized to form an interference fit with the polished bore for actuating the piston upon the application of fluid pressure on the second seal, means for holding the first seal means in an expanded position, a mechanically set seal on the exterior of the housing, said seal includes first and second spaced seals connected together and said seals positioned on opposite sides of the fluid control port, said first and second seals initially having an outer periphery of a size less than the size of the inner periphery of the polished bore and less than the outside diameter of the housing, one end of the mechanically set seal positioned against the housing and the mechanical set seal having a no-go shoulder for engaging the well conduit for expanding the mechanically set seal, and means for holding the mechanically set seal in an expanded position.

5. The apparatus of claim 4 wherein said first and second spaced seals include a metal seal.

6. A retrievable subsurface well safety valve for controlling fluid flow through a well conduit having a polished bore comprising, a tubular housing having a fluid control port and having a bore and having a valve closure member moving between open and closed positions for controlling the fluid flow through the bore, a flow tube telescopically moving in the housing for controlling the movement of the valve closure member, biasing means for moving the flow tube in a direction to close the valve, piston and cylinder assembly means in the housing, said assembly engaging the flow tube and said assembly exposed to the fluid port for receiving control fluid for actuating the assembly and flow tube, a mechanically set seal on the exterior of the housing, said seal includes first and second spaced seals connected together and said seals positioned on opposite sides of the fluid control port, said first and second seals initially having an outer periphery of a size less than the size of the inner periphery of the polished bore and less than the outside diameter of the housing, one end of the mechanically set seal positioned against the housing and the mechanical set seal having a no-go shoulder for engaging the well conduit for expanding the mechanically set seal, and means for holding the mechanically set seal in an expanded position.

7. A retrievable subsurface well safety valve for controlling fluid flow through a well conduit having a polished bore comprising, a tubular housing having a fluid control port and having a bore and having a valve closure member moving between open and closed positions for controlling the fluid flow through the bore, a flow tube telescopically moving in the housing for controlling the movement of the valve closure member, biasing means for moving the flow tube in a direction to close the valve, ceramic piston and ceramic assembly means in the housing, said assembly engaging the flow tube and said assembly exposed to the fluid port for receiving control fluid for actuating the assembly and flow tube, first initially retracted metal seal means on the exterior of the housing on each side of the fluid control port, said seal means initially having an outer periphery of a size less than the size of the inner periphery of the polished bore and less than the outside diameter of the housing, second initially retracted external metal seal means supported by the housing adjacent to and above the valve closure member, said second seal means initially having an outer periphery of a size less than the size of the inner periphery of the polished bore, means for expanding the first and second seal means into sealing engagement with the polished bore, and means for holding the first and second seal means in an expanded position.

* * * * *

UNITED STATES PATENT OFFICE

CERTIFICATE OF CORRECTION

Patent No. 4,691,776 Dated September 8, 1987

Inventor(s) Ronald E. Pringle

It is certified that error appears in the above-identified patent and that said Letters Patent are hereby corrected as shown below:

Column 2, line 66, after "1C" insert -- are --

Column 3, line 15, correct "IC" to -- 1C --

Column 7, line 36, delete "deal" and insert -- seal --

Signed and Sealed this

Seventeenth Day of May, 1988

*Attest:*

DONALD J. QUIGG

*Attesting Officer*

*Commissioner of Patents and Trademarks*